US008674272B2

(12) United States Patent
Fujinami et al.

(10) Patent No.: US 8,674,272 B2
(45) Date of Patent: Mar. 18, 2014

(54) INDUCTION HEATING COOKER

(75) Inventors: Tomoya Fujinami, Shiga (JP); Sunao Okuda, Shiga (JP); Naoaki Ishimaru, Shiga (JP); Akira Kataoka, Shiga (JP)

(73) Assignee: Panasonic Corporation, Osaka (JP)

( * ) Notice: Subject to any disclaimer, the term of this patent is extended or adjusted under 35 U.S.C. 154(b) by 283 days.

(21) Appl. No.: 13/125,237

(22) PCT Filed: Oct. 22, 2009

(86) PCT No.: PCT/JP2009/005554
§ 371 (c)(1),
(2), (4) Date: Apr. 20, 2011

(87) PCT Pub. No.: WO2010/050159
PCT Pub. Date: May 6, 2010

(65) Prior Publication Data

US 2011/0198342 A1 Aug. 18, 2011

(30) Foreign Application Priority Data

Oct. 29, 2008 (JP) ..... 2008-277975
Aug. 6, 2009 (JP) ..... 2009-183016

(51) Int. Cl.
*H05B 6/12* (2006.01)

(52) U.S. Cl.
USPC ..... 219/620; 219/627

(58) Field of Classification Search
USPC ..... 219/620, 621, 622, 623, 624, 625, 626, 219/627, 635, 446.1, 448.11
See application file for complete search history.

(56) References Cited

U.S. PATENT DOCUMENTS

| | | | | |
|---|---|---|---|---|
| 4,151,387 | A * | 4/1979 | Peters, Jr. | 219/626 |
| 6,169,486 | B1 * | 1/2001 | Berkcan et al. | 340/584 |
| 2005/0067408 | A1 * | 3/2005 | Fujii et al. | 219/619 |
| 2007/0278216 | A1 * | 12/2007 | Tominaga et al. | 219/627 |

FOREIGN PATENT DOCUMENTS

| | | | | |
|---|---|---|---|---|
| CN | 1549653 | A | 11/2004 | |
| JP | 2005-024330 | A | 1/2005 | |
| JP | 2005-122962 | A | 5/2005 | |
| JP | 2005122962 | A * | 5/2005 | H05B 6/12 |

(Continued)

OTHER PUBLICATIONS

International Search Report for International Application No. PCT/JP2009/005554, dated Jan. 26, 2010, 2 pages.

(Continued)

*Primary Examiner* — Henry Yuen
*Assistant Examiner* — Hemant Mathew
(74) *Attorney, Agent, or Firm* — Brinks Gilson & Lione

(57) ABSTRACT

An induction heating cooker includes: a top plate on which a cooking container is placed; a temperature measuring device which has an infrared ray sensor operable to detect infrared rays radiated from the cooking container and a temperature converting unit operable to calculate a temperature of the cooking container from an output of the infrared ray sensor; a heating coil operable to receive a supply of a high frequency current and generate an induction magnetic field for heating the cooking container; and a heating control unit operable to control the high frequency current of the heating coil based on the temperature measured by the temperature measuring device, and control heating power to be supplied to the cooking container. The temperature measuring device further includes a temperature detecting unit operable to measure a temperature of the infrared ray sensor, and calculate the temperature of the cooking container from an output of the infrared ray sensor based on the temperature of the infrared ray sensor measured by the temperature detecting unit.

9 Claims, 7 Drawing Sheets

(56) References Cited

FOREIGN PATENT DOCUMENTS

| | | | | | |
|---|---|---|---|---|---|
| JP | 2005-347000 | A | | 12/2005 | |
| JP | 2005347000 | A | * | 12/2005 | ..... H05B 6/12 |
| JP | 2006-260941 | A | | 9/2006 | |
| JP | 2008-052959 | A | | 3/2008 | |

OTHER PUBLICATIONS

International Preliminary Report on Patentability for International Application No. PCT/JP2009/005554, dated Jun. 16, 2011, 6 pages.
Extended European Search Report for European Application No. 09823272.1, dated Jul. 18, 2012, 4 pages.

* cited by examiner

2

INDUCTION HEATING COOKER

This application is a 371 application of PCT/JP2009/005554 having an international filing date of Oct. 22, 2009, which claims priority to JP2008-277975 filed on Oct. 29, 2008 and JP2009-183016 filed on Aug. 6, 2009, the entire contents of which are incorporated herein by reference.

TECHNICAL FIELD

The present invention relates to an induction heating cooker which performs induction-heating of a cooking container, and more particularly, to an induction heating cooker which controls heating based on temperature of the cooking container detected by an infrared ray sensor.

BACKGROUND ART

An amount of infrared energy outputted from an infrared ray sensor changes due to temperature of a infrared ray sensor. Hence, to suppress change of an output of the infrared ray sensor caused by a rise in the temperature of the infrared ray sensor, a conventional induction heating device (for example, fixing device) is provided with cooling means for cooling the infrared ray sensor by supplying air to a temperature detecting module (including infrared ray sensor) (see, for example, Patent Document 1).

Patent Document 1: JP-A-2005-24330

SUMMARY OF THE INVENTION

Problems to be Solved by the Invention

However, a conventional configuration requires the cooling means and therefore has the following various problems. For example, when a cooling fan is used as the cooling means, a device would become larger and an operating sound of the cooling fan would give discomfort to a user. Further, when a configuration using a Peltier element as the cooling means to make a temperature of an infrared ray sensor constant is employed, there is a problem that cost of a device is high. In contrast, when the cooling means is not used, the amount of infrared energy outputted by the infrared ray sensor changes according to the temperature of the infrared ray sensor, and therefore it is not possible to accurately detect the temperature of a measurement object (specifically, a cooking container).

The present invention is made to solve the above conventional problems, and an object of the present invention is to provide an induction heating cooker which can accurately detect a temperature of a measurement object (specifically, the cooking container) without the cooling means.

Means for Solving the Problem

An induction heating cooker according to the present invention includes a top plate on which a cooking container is placed, a temperature measuring device which includes an infrared ray sensor operable to detect infrared rays radiated from the cooking container and a temperature converting unit operable to calculate a temperature of the cooking container from an output of the infrared ray sensor, and which is operable to detect the infrared rays radiated from the cooking container through the top plate to measure the temperature of the cooking container, a heating coil operable to generate an induction magnetic field for heating the cooking container by receiving a supply of a high frequency current, and a heating control unit operable to control power for heating the cooking container by controlling the high frequency current of the heating coil based on the temperature measured by the temperature measuring device, wherein the temperature measuring device further includes a temperature detecting unit operable to measure a temperature of the infrared ray sensor, and calculates the temperature of the cooking container from an output of the infrared ray sensor based on the temperature of the infrared ray sensor measured by the temperature detecting unit. Accordingly, it is possible to accurately detect the temperature of the measurement object (specifically, the cooking container) without using the cooling means.

The temperature measuring device may further include a voltage converting unit operable to convert the output of the infrared ray sensor into a voltage based on a first predetermined amplification factor, an amplifying unit operable to amplify an output of the voltage converting unit based on a second predetermined amplification factor to output to the temperature converting unit, and an amplification factor setting unit operable to change the first predetermined amplification factor and/or the second predetermined amplification factor according to the temperature of the infrared ray sensor measured by the temperature detecting unit. Accordingly, it is possible to prevent the temperature of the infrared ray sensor from rising and a measurable temperature range of a high temperature region from becoming narrow.

The temperature measuring device may further include a voltage converting unit operable to convert the output of the infrared ray sensor into a voltage, and add the converted output of the infrared ray sensor on a reference voltage to output, an amplifying unit operable to amplify an output of the voltage converting unit to output to the temperature converting unit, and a reference voltage changing unit operable to change a value of the reference voltage according to the temperature of the infrared ray sensor measured by the temperature detecting unit. Accordingly, it is possible to prevent the temperature of the infrared ray sensor from rising and a measurable temperature range of a low temperature region from becoming narrow.

The temperature measuring device may further include a voltage converting unit operable to convert the output of the infrared ray sensor into a voltage based on a first predetermined amplification factor, and add the converted output of the infrared ray sensor on a reference voltage to output, an amplifying unit operable to amplify an output of the voltage converting unit based on a second predetermined amplification factor to output to the temperature converting unit, an amplification factor changing unit operable to change the first predetermined amplification factor and/or the second predetermined amplification factor according to the temperature of the infrared ray sensor measured by the temperature detecting unit, and a reference voltage changing unit operable to change a value of the reference voltage according to the temperature of the infrared ray sensor measured by the temperature detecting unit.

The temperature measuring device may change the reference voltage preferentially over a change of an amplification factor.

The temperature measuring device may simultaneously change the first predetermined amplification factor of the voltage converting unit and/or the second predetermined amplification factor of the amplifying unit when the reference voltage is switched.

The temperature measuring device may change the reference voltage when an output voltage of the amplifying unit becomes lower than the reference voltage.

The temperature measuring device may change the reference voltage when the temperature measured by the temperature detecting unit reaches a predetermined temperature or more.

The temperature measuring device may set the first predetermined amplification factor of the voltage converting unit greater than the second predetermined amplification factor of the amplifying unit. Accordingly, it is possible to prevent deterioration of an S/N ratio.

The infrared ray sensor may be a quantum-type infrared ray sensor. According to the present invention, even very small infrared energy can be detected.

Effect of the Invention

In the present invention, by correcting an output value of the infrared ray sensor according to the temperature of the infrared ray sensor and calculating the temperature of a cooking container from the corrected output of the infrared ray sensor, the temperature of the measurement object (specifically, the cooking container) can be accurately detected without using the cooling means. For example, by changing the amplification factor of at least one of the voltage converting unit operable to convert the output of the infrared ray sensor into the voltage and the amplifying unit operable to amplify the output of the voltage converting unit, according to the temperature of the infrared ray sensor, it is possible to prevent the measurable temperature range of the high temperature region from becoming narrow. Further, for example, by changing the value of the reference voltage on which the output voltage of the infrared ray sensor is added in the voltage converting unit according to the temperature of the infrared ray sensor, it is possible to prevent the measurable temperature range of the low temperature region from becoming narrow. Consequently, according to the present invention, the temperature of a cooking container in a wide range can be measured without cooling the infrared ray sensor.

DETAILED DESCRIPTION OF THE PREFERRED EMBODIMENTS

Hereinafter, embodiments of the present invention will be described with reference to the drawings.

Embodiment 1

In an induction heating cooker according to Embodiment 1 of the present invention, by changing an amplification factor for amplifying an output of an infrared ray sensor based on a temperature of the infrared ray sensor, a measurable temperature range of the high temperature region can be prevented from becoming narrow, and the temperature of a cooking container can be accurately detected.

1.1 Configuration of Induction Heating Cooker

Figure 1:
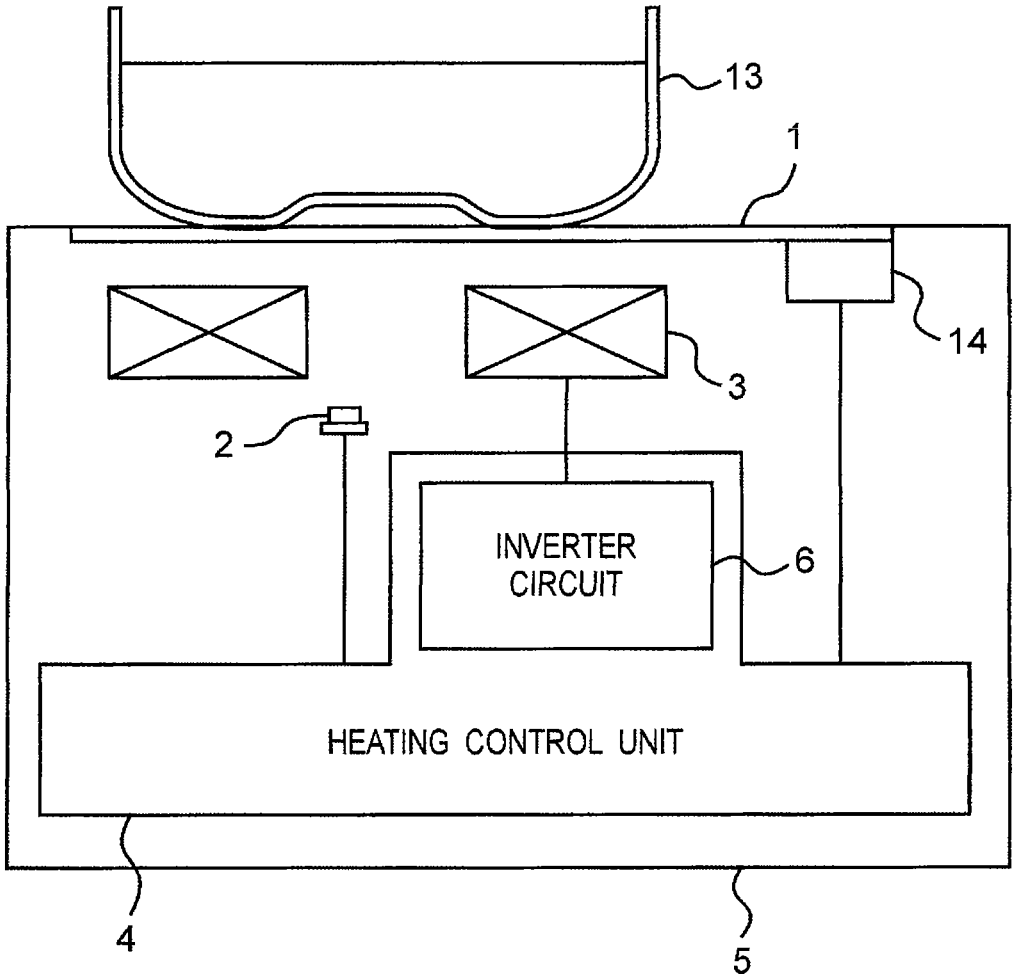
FIG. 1 is a diagram illustrating a configuration of an induction heating cooker according to Embodiment 1 of the present invention.

FIG. 1 illustrates a configuration of the induction heating cooker according to Embodiment 1 of the present invention. In FIG. 1, the induction heating cooker includes a top plate 1 on which a cooking container 13 is placed, and a heating coil 3 which is provided below the top plate 1 and which heats the cooking container 13 by induction heating. The cooking container 13 is placed in a position opposed to the heating coil 3 in the upper surface of the top plate 1.

The induction heating cooker according to the present embodiment further includes a temperature measuring device 2 which detects infrared rays radiated from the cooking container 13 through the top plate 1, and measures the temperature of the cooking container 13, and a heating control unit 4 which controls power for heating the cooking container 13 by controlling a high frequency current to be supplied to the heating coil 3 based on the temperature measured by the temperature measuring device 2. The temperature measuring device 2 is provided in a position opposed to the cooking container 13, and receives the infrared rays radiated from the cooking container 13. The heating control unit 4 includes an inverter circuit 6 which supplies the high frequency current to the heating coil 3.

The temperature measuring device 2, the heating coil 3 and the heating control unit 4 are accommodated in an outer case 5. The top plate 1 is provided in the upper part of the outer case 5, and forms a part of an outer.

The induction heating cooker according to the present embodiment further includes an operating unit 14 which receives an input of a control command to start or stop heating of the heating cooker 13 from a user. In addition to making a determination of heating output, the operating unit 14 is operated in receiving an input of a control command to select a timer function or functions such as automatic cooking setting.

The temperature measuring device 2 and the operating unit 14 are electrically connected to the heating control unit 4. The inverter circuit 6 of the heating control unit 4 controls power for heating the cooking container 13 by controlling the high frequency current to be supplied to the heating coil 3, based on the temperature measured by the temperature measuring device 2 and the control command inputted through the operating unit 14.

Figure 2:
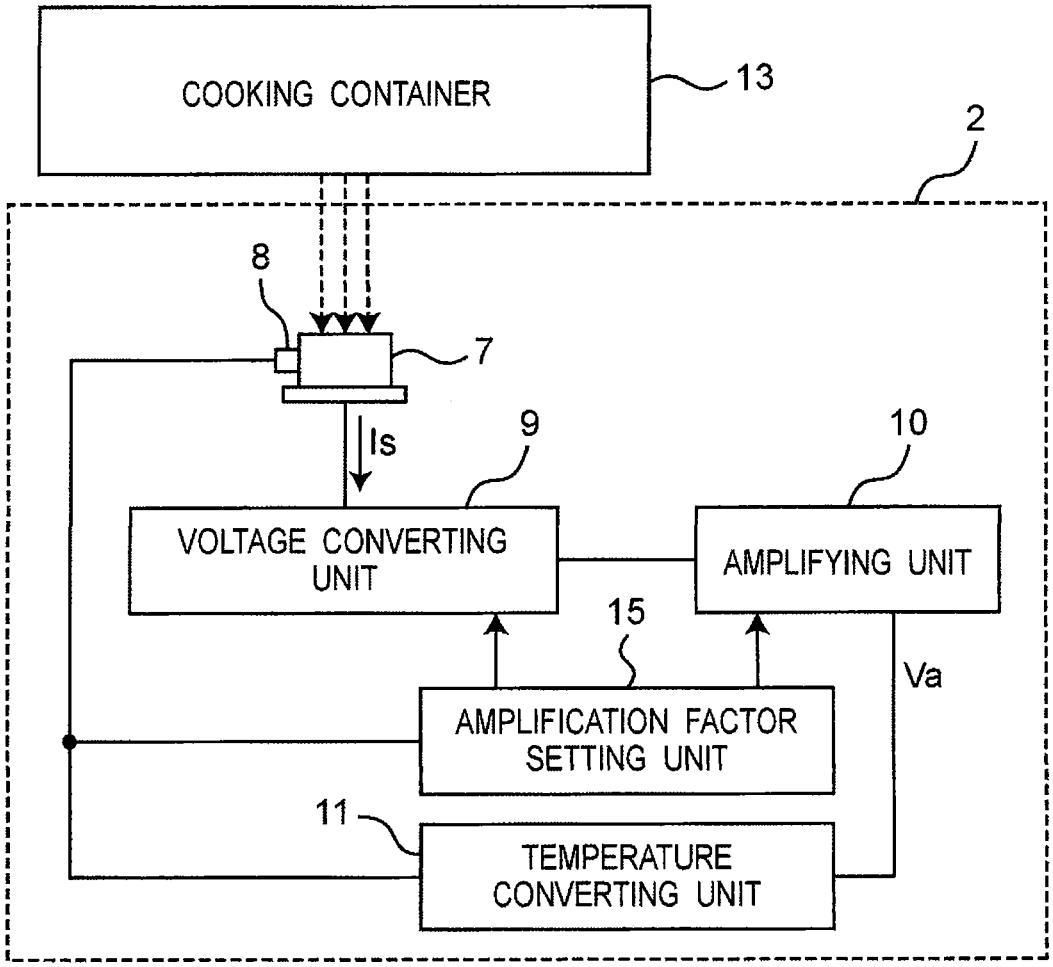
FIG. 2 is a block diagram illustrating a configuration of a temperature measuring device according to Embodiment 1 of the present invention.

FIG. 2 illustrates a configuration of the temperature measuring device 2. The temperature measuring device 2 includes an infrared ray sensor 7, a temperature detecting unit 8 which measures the temperature of the infrared ray sensor 7, a voltage converting unit 9 which converts the output of the infrared ray sensor 7 into a voltage, an amplifying unit 10 which amplifies the output of the voltage converting unit 9, a temperature converting unit 11 which calculates the temperature of the cooking container 13, i.e., a measurement target, from the output of the amplifying unit 10 and the output of the temperature detecting unit 8, and an amplification factor setting unit 15 which sets the amplification factor of the amplifying unit 10.

The infrared ray sensor 7 receives light of an infrared region radiated from the cooking container 13. The output of the infrared ray sensor 7 changes according to the amount of received light. The output of the infrared ray sensor 7 is converted into an electric signal to obtain necessary information. Generally, an infrared ray sensor is roughly classified into a thermal-type infrared ray sensor and a quantum-type infrared ray sensor. In the present embodiment, the quantum-type infrared ray sensor (specifically, a photodiode) is used as the infrared ray sensor 7. The quantum-type infrared ray sensor 7 converts light energy into electric energy and detects the same by utilizing an electric phenomenon caused by light. In the case of a photodiode, a photovoltaic effect is utilized, that is, an effect that a current proportional to the amount of light flows when light is received is utilized.

The temperature detecting unit 8 measures the temperature of the infrared ray sensor 7. The temperature detecting unit 8 is, for example, a thermistor which detects temperature by thermal conduction. The output of the infrared ray sensor 7 changes according to the temperature of the infrared ray sensor 7 (see FIG. 4A), and therefore the temperature measured by the temperature detecting unit 8 is used to correct the output of the infrared ray sensor 7.

The voltage converting unit 9 converts the output of the infrared ray sensor 7 into a voltage. In the present embodiment, a photodiode which outputs a current is used as the infrared ray sensor 7, and therefore a current-voltage converting circuit is used as the voltage converting unit 9 (which will be described below with reference to FIG. 3). The mode of the output of the infrared ray sensor 7 varies depending on the type of the infrared ray sensor 7, so that it is possible to simplify the configuration of the temperature measuring device 2 by converting the output of the infrared ray sensor 7 into a voltage which is easy to handle in an electric circuit, microcomputer, or the like.

The amplifying unit 10 amplifies the output voltage of the voltage converting unit 9. When the infrared ray sensor 7 is a photodiode, although it depends on the temperature of the cooking container 13 or the chip size of the photodiode, output valve of a current Is outputted from the infrared ray sensor 7 is typically equal to or less than the order of μA. Only several mV is obtained by converting the current Is into a voltage by the voltage converting unit 9, where the voltage is weak against noise, and even if the current Is is further A/D converted by a microcomputer or the like, resolution is low and its usability is low. Hence, the amplifying unit 10 amplifies the voltage outputted from the voltage converting unit 9 to a required and sufficient voltage value.

The temperature converting unit 11 receives an input of the voltage amplified by the amplifying unit 10, and converts the inputted voltage value into the temperature of the cooking container 13. For example, a microcomputer or DSP can be used for the temperature converting unit 11.

Figure 3:
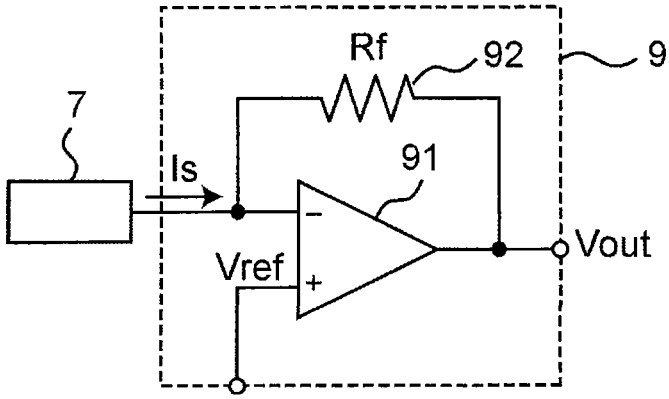
FIG. 3 is a block diagram illustrating a configuration of a voltage converting unit according to Embodiment 1 of the present invention.

FIG. 3 illustrates the configuration of the voltage converting unit 9. The voltage converting unit 9 converts the output of the infrared ray sensor 7 into the voltage and adds the voltage on the reference voltage Vref to output. The voltage converting unit 9 includes an operational amplifier 91 and a resistance 92. A minus terminal of the operational amplifier 91 is connected to the infrared ray sensor 7. The infrared ray sensor 7 (specifically, the photodiode) which has received infrared energy outputs the current Is proportional to the amount of light, and therefore the output of the infrared ray sensor 7 flows toward the output side (toward the amplifying unit 10) through the feedback resistance 92 connected between the minus terminal of the operational amplifier 91 and the output terminal. The plus terminal of the operational amplifier 91 receives an input of a reference voltage Vref, and a product of the current which has flowed through the feedback resistance 92 and the feedback resistance 92 is added on the reference voltage Vref to obtain a voltage Vout of the output terminal. In the present embodiment, although a case that the infrared ray sensor 7 is a photodiode is described, even when the output of the infrared ray sensor 7 corresponds to the change of the resistance value, the same operation is possible by applying a power supply voltage to the infrared ray sensor 7 and receiving an input of the current flowing from the infrared ray sensor 7.

The amplification factor determined as a resistance value Rf of the feedback resistance 92 of the voltage converting unit 9 and the amplification factor of the amplifying unit 10 can be set as necessary. In the present embodiment, the amplification factor of the voltage converting unit 9 is set larger than the amplification factor of the amplifying unit 10. When the infrared ray sensor 7 is a photodiode, the current outputted from the infrared ray sensor 7 is equal to or less than the order of μA, and this small current is amplified to several volt which a microcomputer or the like can handle. The current of the photodiode is very small, and therefore, when the amplification factor of the voltage converting unit 9 is small, there is a risk that the output of the voltage converting unit 9 includes noise when the output is inputted to the amplifying unit 10. Consequently, by increasing the amplification factor of the voltage converting unit 9 more than the amplification factor of the amplifying unit 10, it is possible to prevent deterioration of the S/R ratio.

Figure 4A:
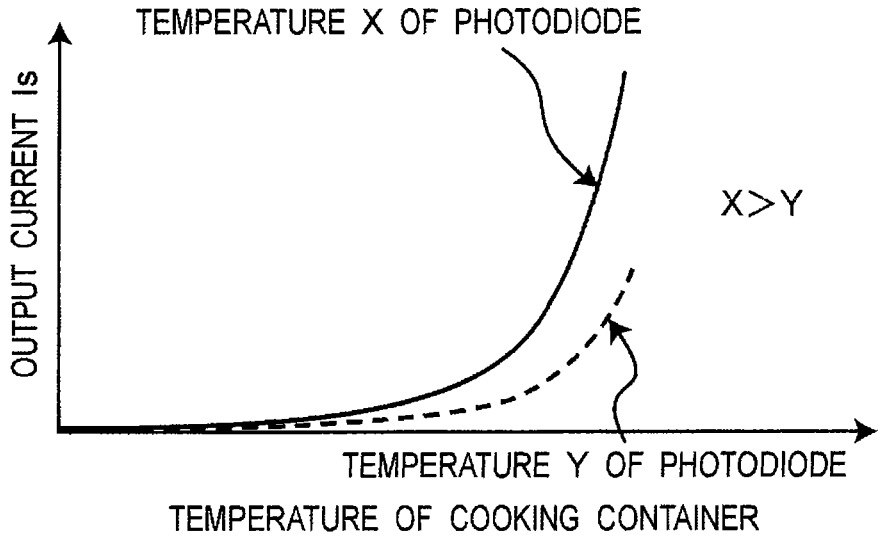
FIG. 4A is a characteristic diagram of an output current according to a temperature of a photodiode.

FIG. 4A illustrates characteristics of the output current of the photodiode. As illustrated in FIG. 4A, the current value outputted from the photodiode changes according to the temperature of the photodiode. More specifically, when the temperature is high (X degrees) (X>Y), the current Is outputted from the photodiode becomes greater compared to when the temperature (Y degrees) of the photodiode is low, even if the temperature of the cooking container 13 which is the measurement target is the same. This is because a parallel resistance in the photodiode becomes low due to the rise of the temperature of the photodiode.

When the temperature of the cooking container 13 becomes high and the temperature of the photodiode becomes high, the output current Is becomes large and therefore a measurable temperature range becomes narrow. This reason will be described with reference to FIG. 4B.

Figure 4B:
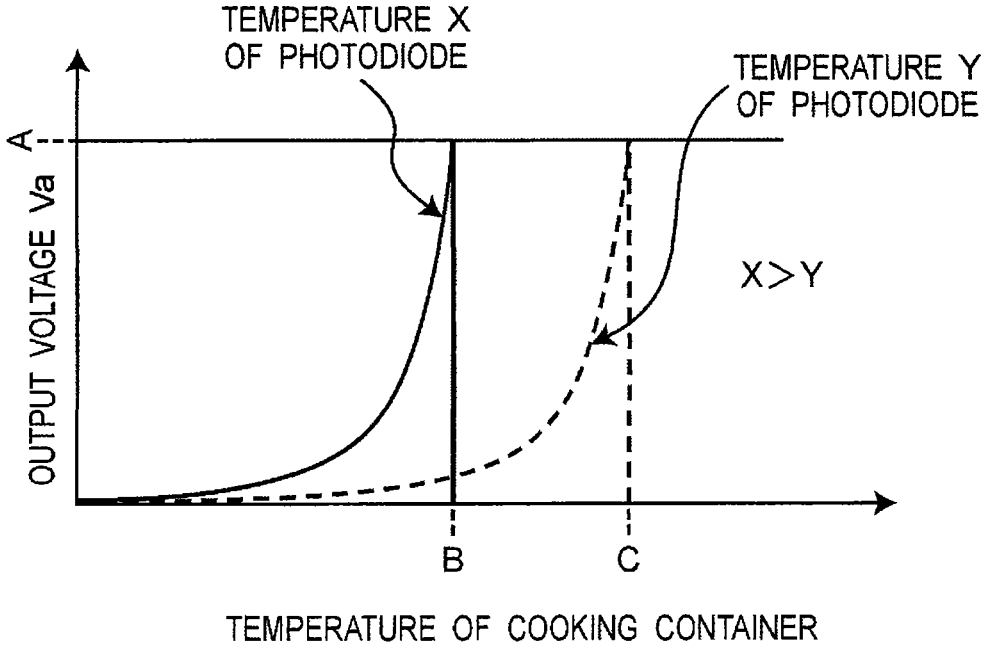
FIG. 4B is a diagram illustrating a relationship between an output voltage of an amplifying unit and a temperature of a cooking container.

FIG. 4B illustrates the relationship between the output voltage Va of the amplifying unit 10 and the temperature of the cooking container 13 that is the measurement target. Although the output of the operational amplifier 91 depends on the type of the operational amplifier, the output is limited by the power supply voltage. More specifically, in the case of the operational amplifier of a Rail to Rail output, an output corresponding to the power supply voltage at maximum is outputted, and if the operational amplifier is not the operational amplifier of the Rail to Rail output, only an output equal to or less than the power supply voltage can be outputted.

As illustrated by the broken line of FIG. 4B, when the temperature of the infrared ray sensor 7 (photodiode) is low (Y degrees), the output voltage Va of the amplifying unit 10 reaches a saturation voltage A when the temperature of the cooking container 13 is C degrees of a high temperature. That is, when the infrared ray sensor 7 is low, the temperature up to C degrees can be detected. In contrast, when the temperature of the infrared ray sensor 7 rises, the output current Is of the infrared ray sensor 7 increases as illustrated in FIG. 4A. As illustrated by the solid line of FIG. 4B, when the temperature of the infrared ray sensor 7 (photodiode) is high (X degrees), the output voltage Va of the amplifying unit 10 reaches the saturation voltage A when the temperature of the cooking container 13 reaches B degrees of a low temperature (B<C). That is, when the infrared ray sensor 7 has a high temperature, only the temperature up to B degrees can be detected. Thus, when the temperature of the infrared ray sensor 7 is high, the output voltage Va of the amplifying unit 10 reaches the saturation voltage A before the temperature of the cooking container 13 becomes high, and therefore the temperature of the cooking container 13 equal to or more than B degrees cannot be detected.

Hence, in the present embodiment, the amplification factor setting unit 15 illustrated in FIG. 2 sets the amplification factor of the amplifying unit 10 according to the temperature of the infrared ray sensor 7 (temperature detected by the temperature detecting unit 8). More specifically, the amplification factor at the time when heating starts or when the temperature of the infrared ray sensor 7 detected by the temperature detecting unit 8 is less than a predetermined temperature, is set to an initial value, and when the temperature of the infrared ray sensor 7 detected by the temperature detecting unit 8 exceeds the predetermined temperature, the amplification factor is decreased less than the initial value. Thus, by changing the amplification factor of the amplifying unit 10 based on the temperature of the infrared ray sensor 7, the output of the infrared ray sensor 7 is corrected. Accordingly, it is possible to more accurately detect the temperature.

1.2 Operation of Induction Heating Cooker

The operation of the induction heating cooker according to the present embodiment will be described with reference to FIG. 5.

When the user presses the switch of the operating unit 14 for inputting a control command to start heating, the control command to start heating is inputted from the operating unit 14 to the heating control unit 4. The heating control unit 4 operates the inverter circuit 6 and supplies the high frequency current to the heating coil 3. Accordingly, the high frequency magnetic field is generated from the heating coil 3, and heating of the cooking container 13 starts (S501). At this time, heating starts with heating power set in advance. When the control command to change the heating power is inputted through the operating unit 14, the heating control unit 4 controls the inverter circuit 6 and heats the cooking container 13 based on the changed heating power. More specifically, the heating control unit 4 detects the current inputted to the inverter circuit 6, compares the heating power set by the user and the current inputted to the inverter circuit 6, and changes the operating state of the inverter circuit 6 based on the comparison result. The heating control unit 4 controls the inverter circuit 6 to provide heating power set by the user, by repeating this operation, and maintains the set heating power.

In the temperature measuring device 2, the temperature detecting unit 8 detects the temperature of the infrared ray sensor 7 (S502). The amplification factor setting unit 15 determines whether or not the detected temperature of the infrared ray sensor 7 is equal to or greater than a predetermined temperature (for example, 250° C.) (S503). If the temperature of the infrared ray sensor 7 is equal to or greater than the predetermined temperature (Yes in S503), the amplification factor setting unit 15 decreases the amplification factor of the amplifying unit 10 (S504). If the temperature of the infrared ray sensor 7 is less than a predetermined temperature (No in S503), the amplification factor setting unit 15 increases the amplification factor of the amplifying unit 10 (S505). More specifically, in the present embodiment, the amplification factor is decreased less than the initial value in step S504, and the amplification factor of the amplifying unit 10 is returned to the initial value in step S505.

The temperature measuring device 2 calculates the temperature of the cooking container 13 (S506). More specifically, the voltage converting unit 9 converts the output of the infrared ray sensor 7 into a voltage, the amplifying unit 10 amplifies the output value of the voltage converting unit 9 based on the amplification factor set in step S504 or S505, and the temperature converting unit 11 converts the amplified voltage value into the temperature of the cooking container 13. The temperature measuring device 2 transmits the converted temperature to the heating control unit 4.

The heating control unit 4 determines whether or not the temperature of the cooking container 13 received from the temperature measuring device 2 is equal to or more than a predetermined set value (for example, 300° C.) (S507). If the temperature of the cooking container 13 is equal to or more than the predetermined set value (Yes in S507), The heating control unit 4 determines that the cooking container 13 is abnormally heated, and the heating control unit 4 temporarily stops the inverter circuit 6 and temporarily stops heating (S508). For example, the heating control unit 4 stops the heating until the temperature of the cooking container 13 becomes less than the predetermined set value. If the temperature of the cooking container 13 is not equal to or more than the predetermined set value (No in S507), the heating control unit 4 determines that the cooking container 13 is heated normally, and the heating control unit 4 continues the heating.

The heating control unit 4 determines whether or not the control command to finish the heating is inputted through the operating unit 14 (S509). If the control command to finish the heating is inputted (Yes in S509), the heating control unit 4 stops the operation of the inverter circuit 6 and finishes the heating. If the control command to finish the heating is not inputted (No in S509), the process returns to step S501 and continues the heating with the set heating power.

1.3 Conclusion

The induction heating cooker according to the present embodiment decreases the amplification factor of the amplifying unit 10 if the temperature of the infrared ray sensor 7 is higher than a predetermined temperature. Consequently, even when the temperature of the infrared ray sensor 7 is high, the output voltage Va of the amplifying unit 10 is unlikely to be saturated, so that it is possible to prevent the measurable temperature range of the high temperature region of the cooking container 13 from becoming narrow. Accordingly, it is possible to measure the temperature of the cooking container 13 in a wide range without cooling the infrared ray sensor 7. Consequently, it is possible to accurately detect the temperature of the cooking container 13.

Although the amplification factor of the amplifying unit 10 is changed based on the temperature of the infrared ray sensor 7 in the present embodiment, the amplification factor of the voltage converting unit 9 may be changed. Further, both of the amplification factors of the amplifying unit 10 and the voltage converting unit 9 may be changed.

Further, although a quantum-type infrared ray sensor is used as the infrared ray sensor 7 in the present embodiment, a thermal-type infrared ray sensor may be used. The thermal-type infrared ray sensor detects change in electric property of an element generated by rise of temperature of the element of the sensor heated by the thermal effect of infrared rays. For example, when a thermopile is used as the thermal-type infrared ray sensor, the thermopile generates an output (signal) according to infrared energy. The temperature detecting unit 8 can measure the temperature of the cooking container 13 based on the signal outputted from the thermopile and the temperature of the thermopile. Since the quantum-type infrared ray sensor receives a greater degree of influence of characteristic change caused by the temperature of the infrared ray sensor 7 than the thermal-type infrared ray sensor, the quantum type infrared ray sensor provides a greater effect of controlling the amplification factor in the present embodiment.

Although a case that the inverter circuit 6 is controlled based on the set heating power is described as an example of the induction heating cooker in the above embodiment, setting of the amplification factor of the present embodiment can be applied to other heating control. For example, the present embodiment is also applicable to cooking of fried food which is one of automatic cooking functions. In the case of fried food cooking, when the user presses a fried food automatic cooking start-switch of the operating unit 14, and then sets the set temperature to, for example, 180° C. by a temperature adjustment switch of the operating unit 14, the heating control unit 4 controls the inverter circuit 6 based on the temperature of the temperature measuring device 2 such that the temperature of oil in the cooking container 13 reaches 180° C. of the set temperature. When ingredients are put into the cooking container 13 and the oil temperature goes below 180° C., the heating control unit 4 changes the operating state of the inverter circuit 6 and performs control such that the oil temperature becomes 180° C. In such an induction heating cooker, heat generated in the heating coil 3 and heat of the cooking container 13 are transmitted to the top plate 1, and the temperature of the temperature measuring device 2 rises due to, for example, radiation from the top plate 1. When the cooling means is provided to the induction heating cooker as in the conventional technique to prevent the rise in the temperature, there are problems in that a device becomes larger or the operating sound of the cooling fan gives discomfort to the user. However, according to the present embodiment, the amplification factor of the voltage converting unit 9 and/or the amplification factor(s) of the amplifying unit 10 are changed based on the temperature of the infrared ray sensor 7, so that even if the temperature of the infrared ray sensor 7 rises, it is possible to prevent a measurable temperature range from becoming narrow. Consequently, it is possible to measure the temperature without enlarging the device and giving discomfort due to the operating sound of the cooling fan. According to the induction heating cooker of the present embodiment, good control performance is provided by a quick response of the infrared ray sensor 7, and high performance and safety of the automatic cooking function can be realized.

Embodiment 2

Figure 6:
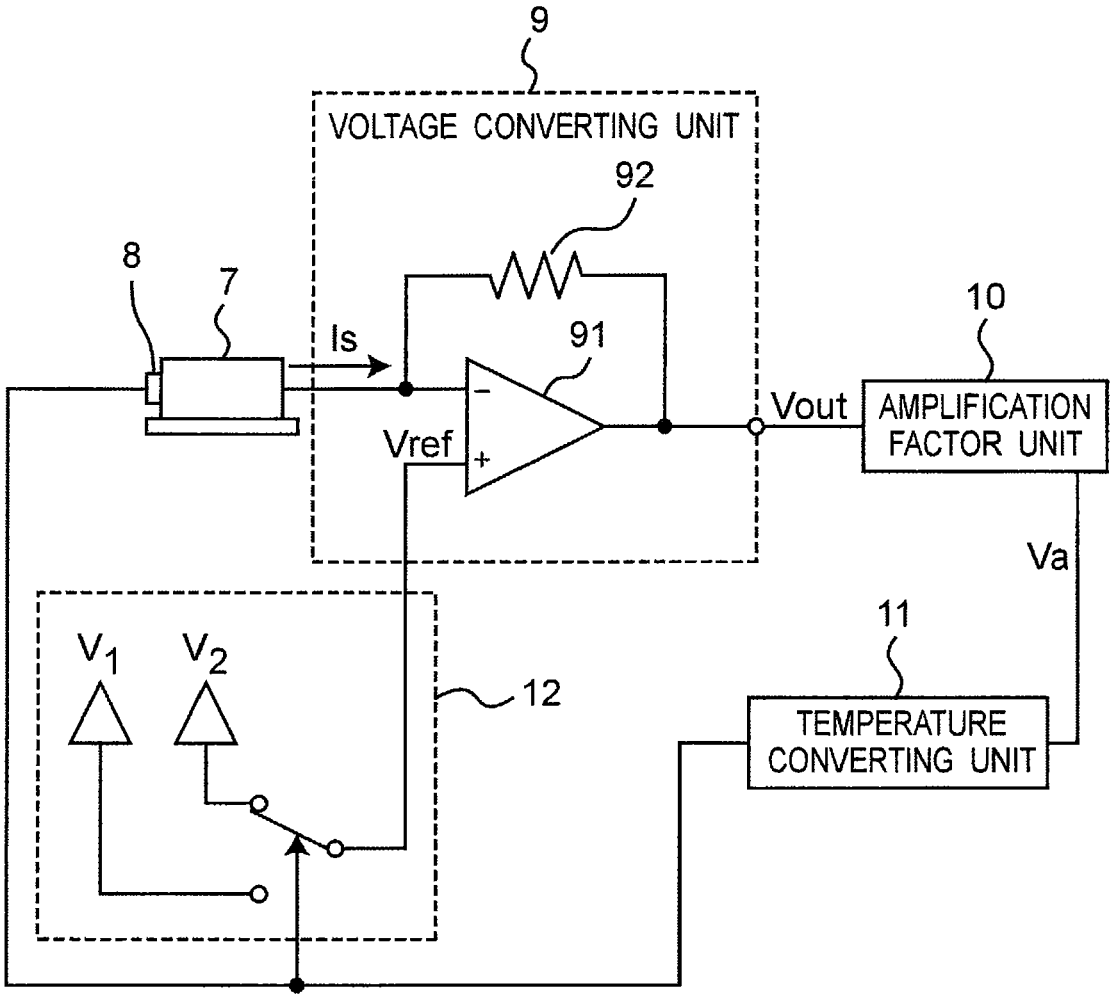
FIG. 6 is a block diagram illustrating a configuration of a temperature measuring device according to Embodiment 2 of the present invention.

An induction heating cooker according to Embodiment 2 of the present invention will be described with reference to FIG. 6 to FIG. 8. The induction heating cooker according to Embodiment 1 prevents the measurable temperature range of the high temperature region from becoming narrow. The induction heating cooker according to Embodiment 2 makes it possible to prevent the measurable temperature range of the low temperature region from becoming narrow. More specifically, by changing the value of the reference voltage used in the voltage converting unit 9 based on the temperature of the infrared ray sensor 7, the measurable temperature range of the low temperature region can be prevented from becoming narrow.

2.1 Configuration of Induction Heating Cooker

In the induction heating cooker according to Embodiment 2 of the present invention, the configurations other than the temperature measuring device 2 are the same as those in Embodiment 1. The temperature measuring device 2 will be described below. FIG. 6 illustrates a configuration of the temperature measuring device 2 in the induction heating cooker according to Embodiment 2 of the present invention. The temperature measuring device 2 according to the present embodiment includes a reference voltage changing unit 12 instead of the amplification factor setting unit 15. In the temperature measuring device 2 according to the present embodiment, the infrared ray sensor 7, the temperature detecting unit 8, the voltage converting unit 9, the amplifying unit 10 and the temperature converting unit 11 are the same as those in Embodiment 1.

In the present embodiment, the reference voltage changing unit 12 selectively switches a value of the reference voltage Vref to be inputted to the plus terminal of the operational amplifier 91 of the voltage converting unit 9, to a low voltage value V1 or high voltage value V2 (V2>V1) according to the temperature of the infrared ray sensor 7 detected by the temperature detecting unit 8.

2.2 Operation of Induction Heating Cooker

Figure 7:
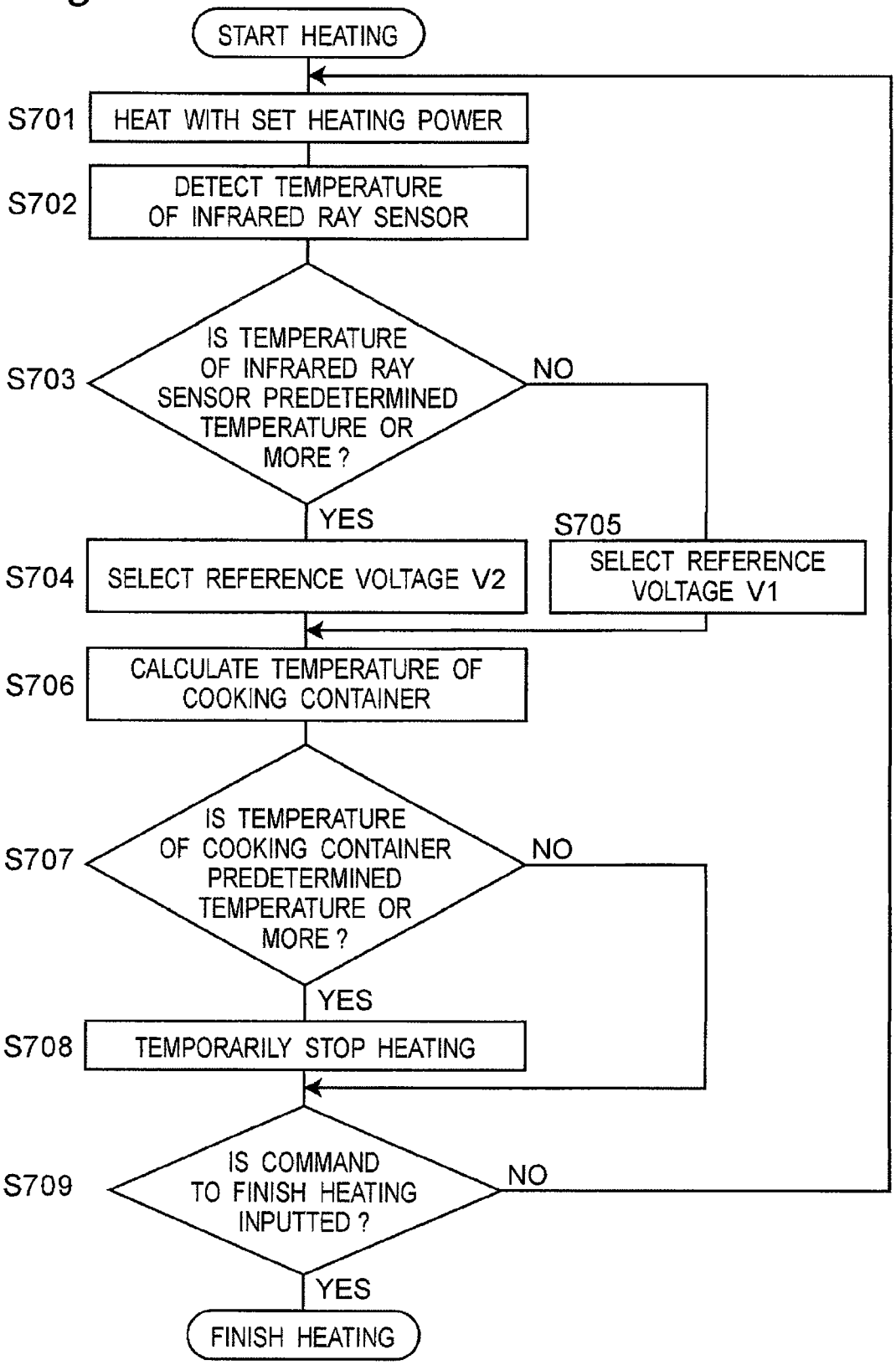
FIG. 7 is a flowchart illustrating an operation of an induction heating cooker according to Embodiment 2 of the present invention.

FIG. 7 illustrates the operation of the induction heating cooker according to Embodiment 2 of the present invention. In the flowchart of FIG. 7, operation steps S701 to S703 and S706 to S709 other than steps S704 and S705 are the same as the operation steps S501 to S503 and S506 to S509 in FIG. 5, and therefore detailed description thereof will not be given. In the present embodiment, the reference voltage changing unit 12 determines whether or not the temperature of the infrared ray sensor 7 detected by the temperature detecting unit 8 is equal to or more than a predetermined temperature (for example, 150° C.) (S703). If the temperature of the infrared ray sensor 7 is less than a predetermined temperature (No in S703), the reference voltage changing unit 12 selects a low reference voltage V1, and if the temperature of the infrared ray sensor 7 detected by the temperature detecting unit 8 is equal to or more than the predetermined temperature (Yes in S703), the reference voltage changing unit 12 selects a high reference voltage V2.

Figure 8A:
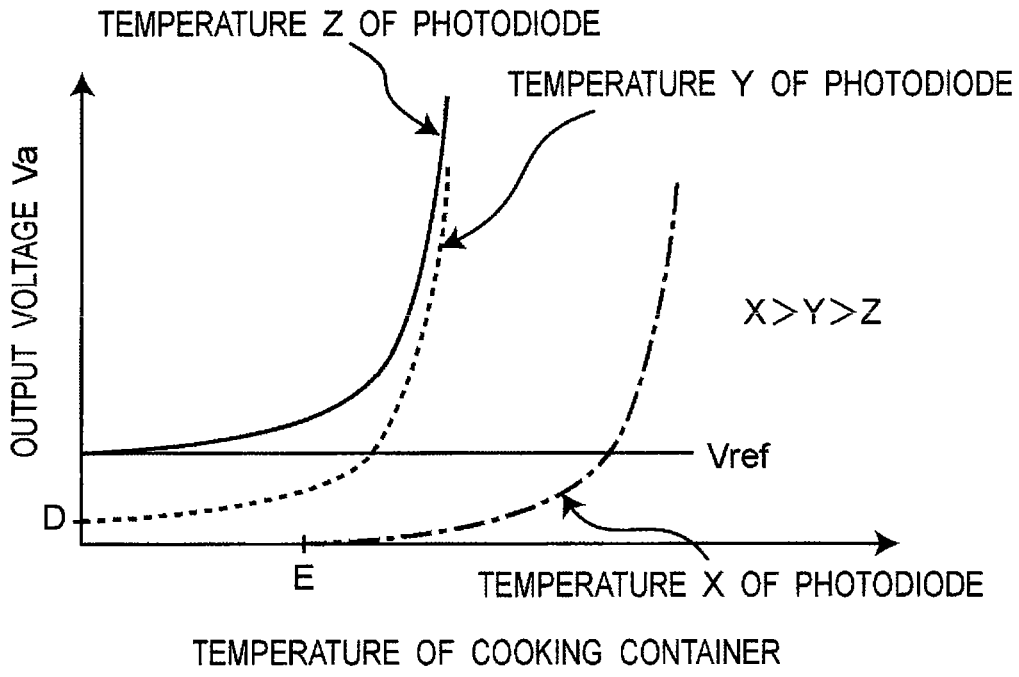
FIG. 8A is a diagram illustrating a relationship between an output voltage of an amplifying unit and a temperature of a cooking container when a reference voltage is constant.
Figure 8B:
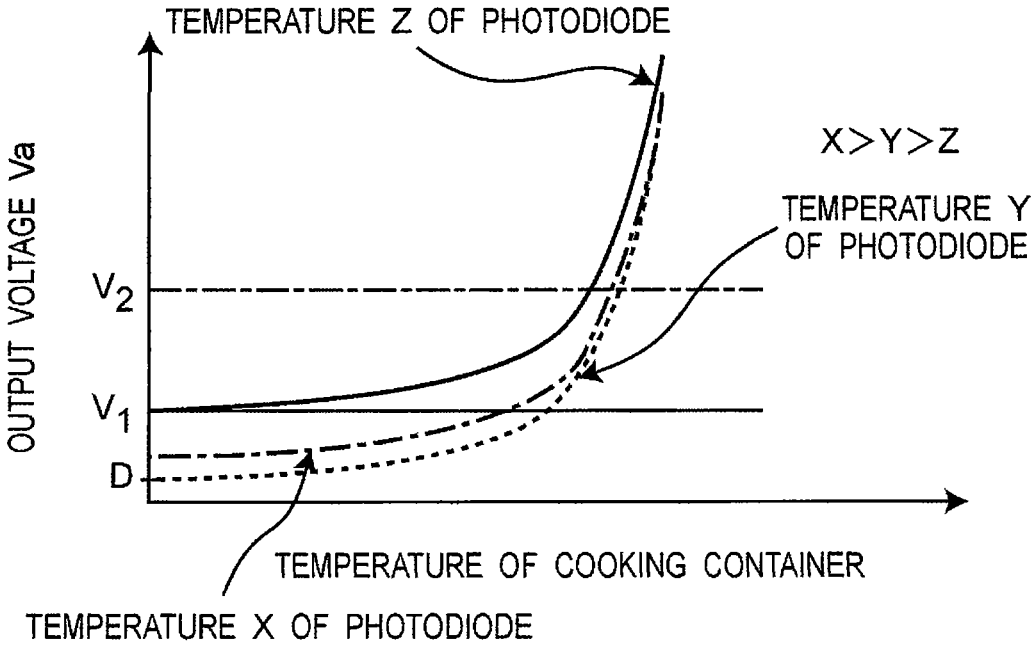
FIG. 8B is a diagram illustrating a relationship between the output voltage of the amplifying unit and the temperature of the cooking container when the reference voltage is variable according to Embodiment 2 of the present invention.

FIG. 8A illustrates the relationship between the output voltage Va of the amplifying unit 10 and the temperature of the cooking container 13 when the reference voltage changing unit 12 is not provided (that is, when the reference voltage Vref is constant), and FIG. 8B illustrates the relationship between the output voltage Va of the amplifying unit 10 and the temperature of the cooking container 13 when the reference voltage changing unit 12 according to the present embodiment is provided (that is, when the reference voltage Vref is variable).

In FIG. 8A, when the temperature of the infrared ray sensor 7 (photodiode) is a temperature Z (about a room temperature equal to or less than 30° C.) (solid line), the amplifying unit 4 outputs a voltage higher than the reference voltage Vref as the output voltage Va based on the reference voltage Vref. In contrast, when a temperature Y of the infrared ray sensor 7 is higher than the temperature of the cooking container 13, the current which originally flows toward the operational amplifier 91 of the voltage converting unit 9 from the infrared ray sensor 7 flows reversely. Therefore, the amplifying unit 10 outputs the output voltage Va based on a voltage D equal to or less than the reference voltage Vref (broken line). Further, when the temperature of the infrared ray sensor 7 rises and reaches X degrees (X>Y>Z), the output voltage Va of the amplifying unit 10 at the time when the temperature of the target object (cooking container 13) is low adheres to 0 V. In this case, when the temperature of the cooking container 13 reaches E degrees of a high temperature (for example, 150° C.), the output starts (dashed line). In this manner, when the temperature of the infrared ray sensor 7 rises and the output of the amplifying unit 10 adheres to 0 V, the measurable temperature range of the low temperature region becomes narrow. Further, when the temperature of the infrared ray sensor 7 becomes high, the temperature of the operational amplifier 91 rises. An input offset voltage of the operational amplifier 91 has a temperature drift, and when the temperature rises, the characteristics of the input offset voltage deteriorates. If the voltage multiplied with the feedback resistance Rf-fold to the input offset voltage is further added on the reference voltage Vref, the measurable temperature range of a low temperature region further becomes narrow. Thus, when the reference voltage Vref is constant, there are cases where the measurable temperature range of a low temperature region becomes narrow.

In FIG. 8B, when the temperature of the infrared ray sensor 7 is Z degrees or Y degrees that are relatively low, the output voltage Va of the amplifying unit 10 is not saturated, and therefore there is no trouble in measuring the temperature of the cooking container 13. Hence, when the temperature of the infrared ray sensor 7 is Z degrees or Y degrees that are relatively low, the reference voltage changing unit 12 sets the reference voltage Vref to a low voltage value V1. However, if the reference voltage Vref is left at a low voltage value V1, the output voltage Va adheres to 0 V as illustrated in FIG. 8A when the temperature of the infrared ray sensor 7 becomes X degrees that is a high temperature. Hence, when the temperature of the infrared ray sensor 7 is X degrees that is a high temperature, the reference voltage changing unit 12 increases the reference voltage Vref to a high voltage value V2. In this manner, even when the temperature of the infrared ray sensor 7 is X degrees (dashed line), the output voltage Va does not adhere to 0 V and the output starts. Accordingly, it is possible to measure the temperature without narrowing the measurable temperature range of a low temperature region.

2.3 Conclusion

In the present embodiment, the reference voltage changing unit 12 changes the value of the reference voltage Vref according to the temperature of the infrared ray sensor 7 detected by the temperature detecting unit 8. Accordingly, when the temperature of the infrared ray sensor 7 rises, it is possible to prevent the output voltage of the amplifying unit 10 from adhering to 0 V. Consequently, it is possible to prevent the measurable temperature range of the low temperature region from becoming narrow.

Generally, when the infrared ray sensor 7 and measurement environment are determined, the relationship between the temperature measured by the temperature detecting unit 8 and the reference voltage Vref and the measurable temperature range of the cooking container 13 are determined. The measurement environment refers to the distance between the infrared ray sensor 7 and the cooking container 13, the optical path therebetween, and optical characteristics in the surrounding of the infrared ray sensor 7. For example, when the infrared ray sensor 7 is a photodiode, the relationship between the temperature measured by the temperature detecting unit 8 and the reference voltage Vref is determined based on the parallel resistance of the photodiode and the characteristics of the operational amplifier 91 used in the current-voltage converting circuit. Further, the measurable temperature range is determined according to a sensitivity wavelength region and a sensitivity of the photodiode. When the temperature measuring device 2 is used in a predetermined measurement environment, it is possible to know what degree of the temperature of the infrared ray sensor 7 influences the measurable temperature range, and therefore when such a condition is known in advance, it is possible to prevent the measurable temperature range from becoming narrow by changing the reference voltage Vref at the time when the temperature of the infrared ray sensor 7 reaches a predetermined temperature which causes the influence (for example, the temperature at which the reference voltage Vref becomes 0 V).

2.4 Modified Example 1

Although the value of the reference voltage Vref is changed when the temperature of the infrared ray sensor 7 reaches a predetermined temperature or more in Embodiment 2, the reference voltage Vref may be changed when the output voltage Va of the amplifying unit 10 becomes lower than the reference voltage Vref. When the infrared ray sensor 7 is a photodiode, the voltage converting unit 9 operates as a current-voltage converting circuit. As illustrated in FIG. 6, the plus terminal of the operational amplifier 91 receives an input of the reference voltage Vref, and therefore the current Is which has flowed from the photodiode flows to the feedback resistance 92, and the voltage generated by the current which has flowed to the feedback resistance 92 is added on the reference voltage Vref and becomes the output voltage Vout. When the temperature of the target object is higher than the temperature of the photodiode, if the photodiode is connected such that the current to be outputted flows in a direction of the operational amplifier, when the current of the photodiode reversely flows, the voltage generated by the feedback resistance 92 is subtracted from the reference voltage Vref. That is, the output voltage Vout becomes lower than the reference voltage Vref. In this case, the measurable temperature range of the low temperature region becomes narrow. In such a case, by changing the reference voltage, it is possible to prevent the measurable temperature range from becoming narrow.

2.5 Modified Example 2

Embodiment 1 and Embodiment 2 may be combined. Accordingly, it is possible to prevent the measurable temperature ranges of both of the high temperature region and low temperature region from becoming narrow, and the temperature of the cooking container 13 can be accurately detected.

Further, in this case, in changing the amplification factor and the reference voltage when the temperature measured by the temperature detecting unit 8 is higher than a predetermined temperature, the reference voltage may be changed preferentially over the amplification factor. As described above, when the temperature of the infrared ray sensor 7 rises, the measurable temperature range of the cooking container 13 which is the measurement target becomes narrow both on the high temperature region and low temperature region. At this time, the output voltage Va of the amplifying unit 10 at the time when the temperature of the infrared ray sensor 7 becomes high adheres to 0 V as illustrated in FIG. 8A, and therefore measurement of the low temperature region becomes impossible first. Hence, it is better to preferentially change the reference voltage and measure the temperature of the low temperature region.

Figure 5:
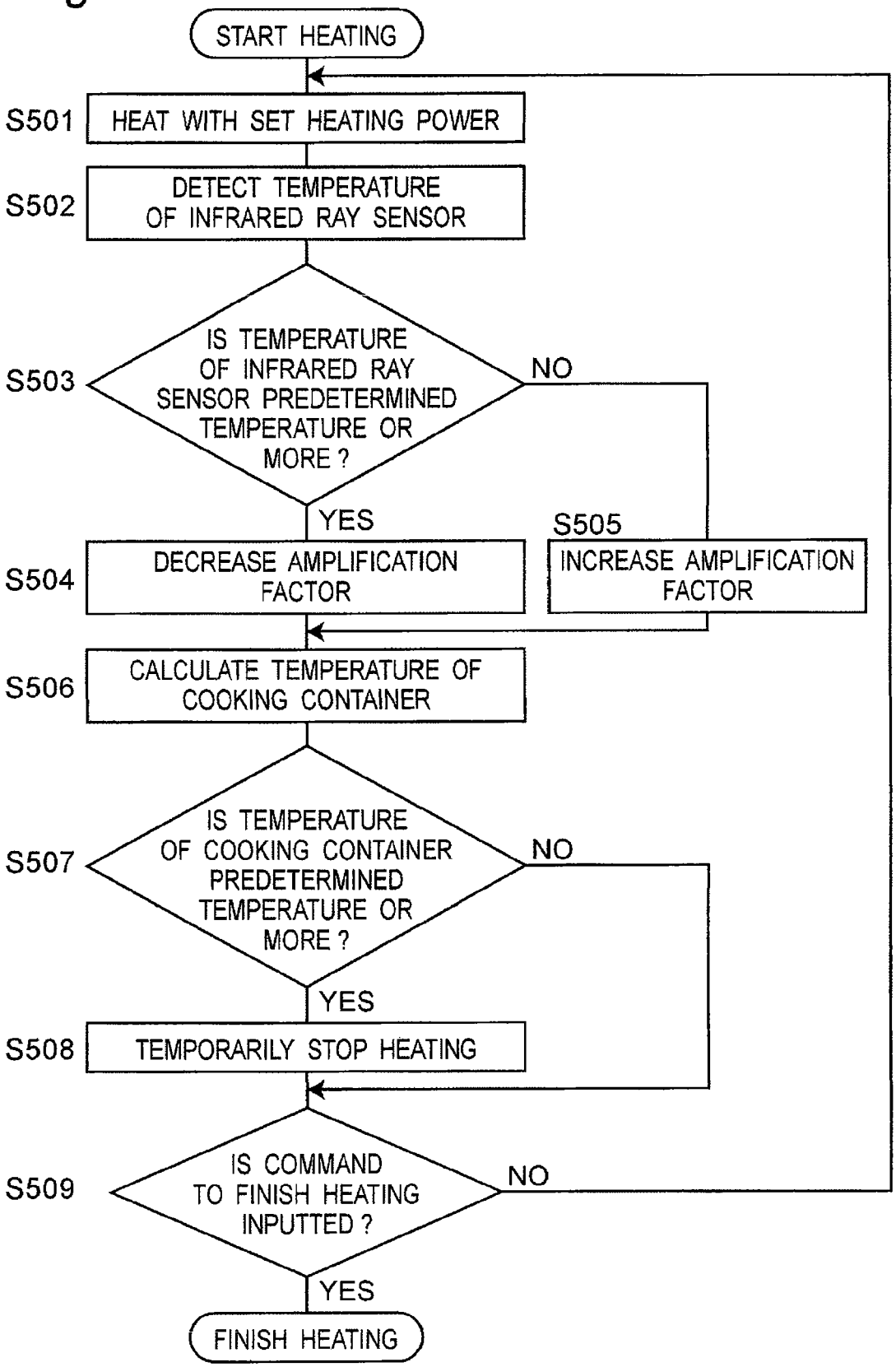
FIG. 5 is a flowchart illustrating an operation of an induction heating cooker according to Embodiment 1 of the present invention.

When the predetermined temperature in step S503 of FIG. 5 and the predetermined temperature in step S703 of FIG. 7 are set to the same temperature, and the reference voltage is switched, the amplification factor(s) of the voltage converting unit 9 and/or the amplification factor of the amplifying unit 10 may be changed simultaneously. By changing the reference voltage when the temperature of the infrared ray sensor 7 rises, it is possible to prevent the output voltage from adhering to 0 V. Further, as illustrated in FIGS. 4A and 4B, when the temperature of the infrared ray sensor 7 rises, even if the temperature of the target object is the same, the output of the infrared ray sensor 7 becomes greater and the output voltage of the amplifying unit 10 is likely to be saturated with the power supply voltage. Hence, the measurable temperature range after the reference voltage is changed is not so wide. Consequently, by simultaneously changing the reference voltage and changing the amplification factor, it is possible to prevent the measurable range from becoming narrow.

Although specific embodiments have been described for the present invention, it is obvious for a person skilled in the art that various modifications, corrections and other utilizations are possible. Consequently, the present invention is not limited to the specific disclosure herein, and can be limited only by the claims attached herewith.

INDUSTRIAL APPLICABILITY

The induction heating cooker according to the present invention has an effect of measuring a temperature of a cooking container in a wide range even when a temperature of an infrared ray sensor rises, and is useful as a heating cooker which is used in, for example, general households, restaurants, and offices.

The invention claimed is:

1. An induction heating cooker comprising:

a top plate on which a cooking container is placed;

a temperature measuring device which includes an infrared ray sensor operable to detect infrared rays radiated from the cooking container through the top plate and a temperature converting unit operable to calculate a temperature of the cooking container from an output of the infrared ray sensor, a heating coil operable to generate an induction magnetic field for heating the cooking container by receiving a supply of a high frequency current; and a heating control unit operable to control power for heating the cooking container by controlling the high frequency current of the heating coil based on the temperature calculated by the temperature measuring device, wherein the temperature measuring device further includes a temperature detecting unit operable to measure a temperature of the infrared ray sensor, and calculates the temperature of the cooking container from an output of the infrared ray sensor based on the temperature of the infrared ray sensor measured by the temperature detecting unit, and wherein the temperature measuring device further includes:

a voltage converting unit operable to convert the output of the infrared ray sensor into a voltage, and add the converted output of the infrared ray sensor on a reference voltage to output;

an amplifying unit operable to amplify an output of the voltage converting unit to output to the temperature converting unit; and a reference voltage changing unit operable to increase a value of the reference voltage when the temperature of the infrared ray sensor measured by the temperature detecting unit rises to a temperature at which the output voltage of the amplifying unit adheres to 0 V.

2. The induction heating cooker according to claim 1, wherein the voltage converting unit converts the output of the infrared ray sensor into a voltage based on the first predetermined amplification factor, and adds the converted output of the infrared ray sensor on a reference voltage to output;

the amplifying unit amplifies an output of the voltage converting unit based on the second predetermined amplification factor to output to the temperature converting unit; and the temperature measuring device further comprises:

an amplification factor changing unit operable to change the first predetermined amplification factor and/or the second predetermined amplification factor according to the temperature of the infrared ray sensor measured by the temperature detecting unit.

3. The induction heating cooker according to claim 2, wherein the temperature measuring device increases the reference voltage preferentially over a change of an amplification factor.

4. The induction heating cooker according to claim 2, wherein the temperature measuring device simultaneously changes the first predetermined amplification factor of the voltage converting unit and/or the second predetermined amplification factor of the amplifying unit when the reference voltage is switched.

5. The induction heating cooker according to claim 1, wherein the temperature measuring device decreases the reference voltage when an output voltage of the amplifying unit becomes lower than the reference voltage.

6. The induction heating cooker according to claim 2, wherein the temperature measuring device sets the first predetermined amplification factor of the voltage converting unit greater than the second predetermined amplification factor of the amplifying unit.

7. The induction heating cooker according to claim 1, wherein the infrared ray sensor is a sensor operable to receive infrared light and convert light energy of the received infrared light into electric energy.

8. The induction heating cooker according to claim 2, wherein the temperature measuring device changes the reference voltage when an output voltage of the amplifying unit becomes lower than the reference voltage.

9. The induction heating cooker according to claim 2, wherein the temperature measuring device decreases the reference voltage when the temperature measured by the temperature detecting unit reaches a predetermined temperature or more.

* * * * *